US006631933B1

(12) United States Patent
Westerwick

(10) Patent No.: US 6,631,933 B1
(45) Date of Patent: Oct. 14, 2003

(54) BOLT FOR MOTOR-VEHICLE DOOR LATCH

(75) Inventor: Volker Westerwick, Bochum (DE)

(73) Assignee: Kiekert AG, Heiligenhaus (DE)

( * ) Notice: Subject to any disclaimer, the term of this patent is extended or adjusted under 35 U.S.C. 154(b) by 58 days.

(21) Appl. No.: 09/654,798

(22) Filed: Sep. 5, 2000

(30) Foreign Application Priority Data

Sep. 9, 1999 (DE) ..... 199 43 083

(51) Int. Cl.[7] ..... E05B 15/02
(52) U.S. Cl. ..... 292/340; 292/341.11; 292/341.12
(58) Field of Search ..... 292/340, 201, 292/216, 341.11, 341.12

(56) References Cited

U.S. PATENT DOCUMENTS 4,896,908 A * 1/1990 Kleefeldt ..... 292/216
4,981,313 A * 1/1991 Makamura ..... 292/340
5,215,342 A * 6/1993 Yuge et al. ..... 292/340
5,494,324 A 2/1996 Kleefeldt
5,636,569 A * 6/1997 Winston ..... 101/333
5,705,212 A * 1/1998 Atkinson ..... 426/115
5,881,615 A * 3/1999 Dahl et al. ..... 81/490
6,267,421 B1 * 7/2001 Burton ..... 292/340

FOREIGN PATENT DOCUMENTS

JP 1-223276 * 1/1989 ..... 292/340

* cited by examiner

*Primary Examiner*—Teri Pham Luu
(74) *Attorney, Agent, or Firm*—Herbert Dubno; Andrew Wilford

(57) ABSTRACT

A bolt assembly is used in combination with a door-post surface formed with at least one centering recess and a motor-vehicle door latch having a pivotable latch element. The assembly has a mounting plate having an inner face engaging the door-post surface and an opposite outer face, a bolt projecting from the outer face and engageable by the latch element, and at least one centering formation projecting from the inner face and engaged in the door-post surface. Friction-increasing surface formations are also provided on the inner face engageable with the door-bolt surface. They can be bumps or ridges formed on the inner flange face. When the flange is formed of a metal core with a plastic covering over the core, the formations are formed by the plastic covering.

12 Claims, 2 Drawing Sheets

BOLT FOR MOTOR-VEHICLE DOOR LATCH

FIELD OF THE INVENTION

The present invention relates to a motor-vehicle door latch. More particularly this invention concerns a bolt for such a latch.

BACKGROUND OF THE INVENTION

A bolt assembly is used in combination with a door-post surface and a motor-vehicle door latch having a pivotable latch element. The bolt assembly has as described in commonly owned U.S. Pat. No. 5,494,324 a metal plate unitarily formed with a pair of flat coplanar flanges each formed with a mounting hole and a holding portion projecting laterally from the flanges. A mass of a durable plastic material generally covers at least the flanges of the plate and forms an outside surface engaging the door-post surface and an inside surface turned away from the door-post surface. The bolt is formed at the holding portion with a transversely open recess adapted to receive the latch element. The flanges have raised portions extending to and exposed at the outside surface for direct contact with the door-post surface but otherwise are wholly imbedded beneath the inside and outside surfaces of the mass at the flanges.

Such a bolt must be mounted with great precision on the door so that the door closes flush with the vehicle body, does not rattle when closed, and so that the closing and opening movements take place quietly and smoothly. The installation is normally done by first securing it finger-tight with two bolts that have heads bearing on the flange plate and a threaded shank passing through slots in the door port seated in nuts welded to a mounting plate inside the door post. The door is fitted and the bolt is moved into the appropriate position, then the bolts are torqued down to lock in the set position. This is a laborious job requiring expert assembly skills and even the use of jigs or templates to determine just where the bolt should be mounted.

OBJECTS OF THE INVENTION

It is therefore an object of the present invention to provide an improved bolt assembly for a motor-vehicle door latch.

Another object is the provision of such an improved bolt assembly for a motor-vehicle door latch which overcomes the above-given disadvantages, that is which facilitates accurate positioning of the bolt assembly on the door post.

SUMMARY OF THE INVENTION

A bolt assembly is used in combination with a door-post surface formed with at least one centering recess and a motor-vehicle door latch having a pivotable latch element. The assembly has according to the invention a mounting plate having an inner face engaging the door-post surface and an opposite outer face, a bolt projecting from the outer face and engageable by the latch element, and at least one centering formation projecting from the inner face and engaged in the door-post surface.

The centering formations allow the bolt assembly to be mounted in the desired position on the door post without the use of a template or jig. In fact the bolt assembly can normally be fixed in its final position as a result of the accurate placement ensured by the centering formations, allowing the mounting bolts to be torqued down all the way on initial installation.

According to the invention friction-increasing surface formations are also provided on the inner face engageable with the door-bolt surface. They can be bumps or ridges formed on the inner flange face. When the flange is formed of a metal core with a plastic covering over the core, the formations are formed by the plastic covering.

The centering formation in accordance with the invention can be unitary with the flange. Alternately it can be formed by a pin or pins set in the flange. The pin can be cylindrical or of polygonal section. The bolt assembly is symmetrical to plane and there are two such centering formations flanking the plane. Normally the recesses or holes in the door post that receive the centering formations are slightly larger than these formations to allow some adjustability of the bolt position. In any case after installation the centering formations further prevent slippage of the bolt assembly on the door post.

The plate and bolt are covered with plastic except at a portion of the bolt engageable with the fork. In addition a decorative cover is fitted over the outer face of the mounting plate. This cover is snap-fitted to the plate. The plastic coating and cover can be colored to match the vehicle, presenting an attractive appearance.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
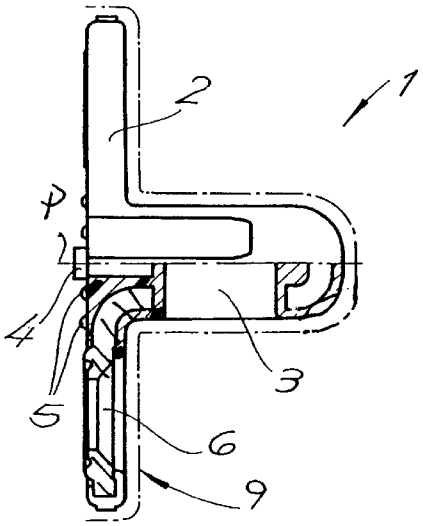
FIG. 3 is a side partly sectional view of the FIG. 1 bolt.
Figure 2:
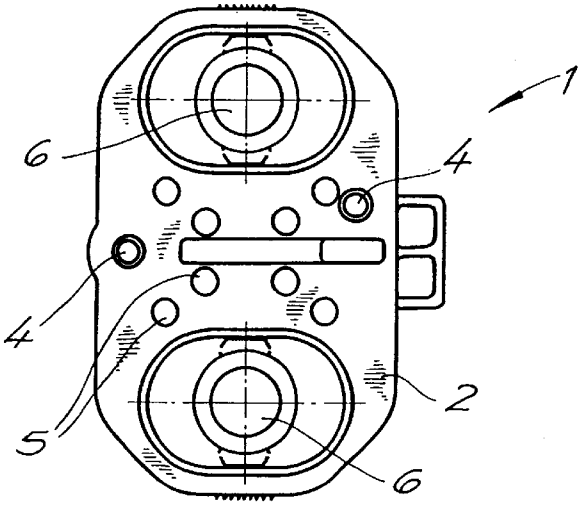
FIG. 2 is a rear elevational view of the FIG. 1 bolt.
Figure 1:
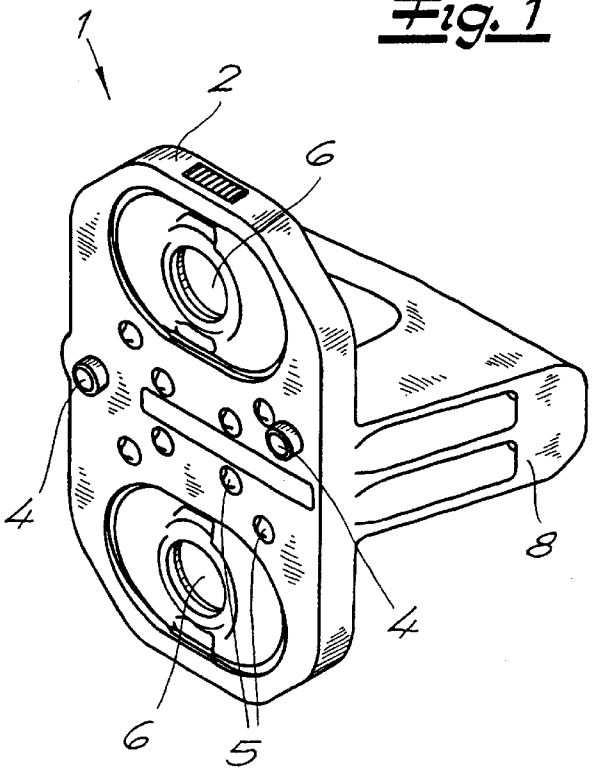
FIG. 1 is a rear perspective view of a bolt assembly according to the invention.

As seen in FIGS. 1, 2, and 3 a door-bolt assembly 1 according to the invention has a steel flange plate 2 to which is mounted a U-shaped circular-section bolt 3 in a standard configuration. In accordance with the invention the back face of the flange 2 is formed with two small centering formations 4 located symmetrically to opposite sides of a symmetry plane P bisecting the bolt 3. The formations 4 are cylindrical, parallel to each other, and project perpendicularly from the back face of the flange 2.

In addition the flange 2 is formed with four gripping formations 5 constituted as small conical bumps also distributed symmetrically to opposite sides of the symmetry plane P. The flange 2 is further formed to each side of the bolt 3 with a large-diameter mounting hole 6. The bolt 3 is covered with a plastic layer 8 and a decorative plastic cap 9 fits over the bolt flange 2. The formations 5 are wholly formed from the plastic layer 8 and the formations 4 are part of the metal of the flange 2 but are surrounded by the plastic with their metallic ends exposed.

Figure 6:
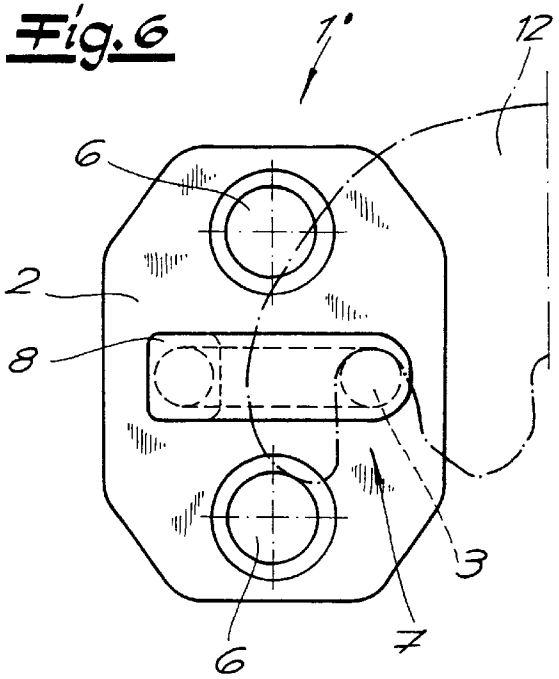
FIG. 6 is a view taken in the direction of arrow VI of FIG. 4.
Figure 4:
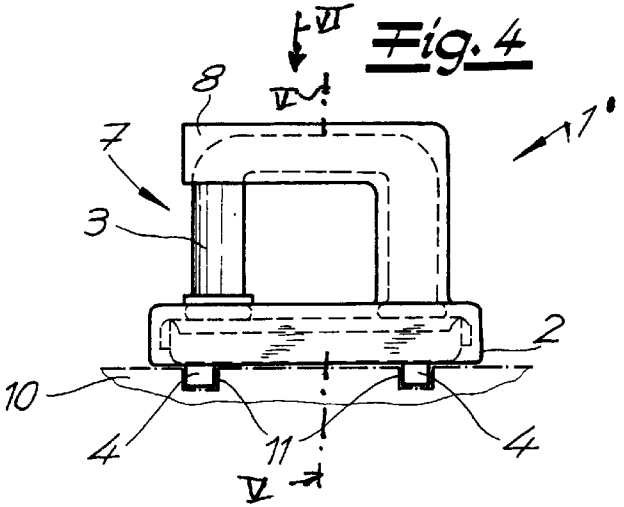
FIG. 4 is a top view of another bolt according to the invention.
Figure 5:
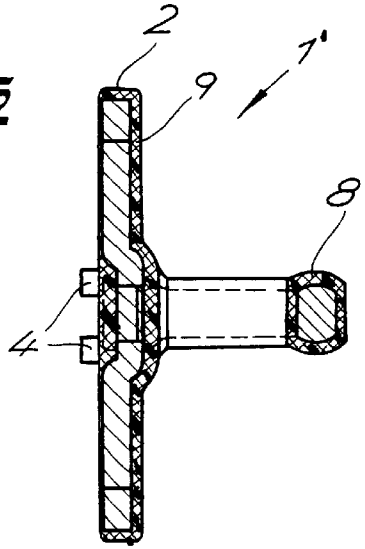
FIG. 5 is a section taken along line V—V of FIG. 4.

The similar bolt 1' shown in FIGS. 4, 5, and 6 is mounted on a door post 10 formed with cavities 11 in which the centering formations 4 are complementarily received. FIG. 6 shows a fork 12 of the door latch that engages around an exposed portion 7 of the bolt 3.

The centering pins or formations 4 allow the bolt assembly 1 to be set in an exact position on the door post 10. This determination of position allows the vehicle door to be mounted and set in proper position much more quickly than in the prior-art system.

I claim:

1. In combination:

a door-post surface formed with at least one centering recess;

a motor-vehicle door latch having a pivotable latch element; and a bolt assembly comprising a mounting plate having an inner face engaging the door-post surface and an opposite outer face;

a bolt projecting from the outer face and engageable by the latch element;

at least one centering formation projecting from the inner face and engaged in the door-post surface; and friction-increasing surface formations on the inner face engageable with the door-bolt surface.

2. The combination defined in claim 1 wherein the friction-increasing formations are bumps formed on the inner plate face.

3. The combination defined in claim 1 wherein the plate is formed of a metal core and a plastic covering over the core, the formations being formed by the plastic covering.

4. The combination defined in claim 1 wherein the centering formation is unitary with the plate.

5. The combination defined in claim 1 wherein the centering formation is a pin projecting from the inner face.

6. The combination defined in claim 1 wherein the bolt assembly is symmetrical to plane and there are two such centering formations flanking the plane.

7. The combination defined in claim 1 wherein the centering formation is set in the plate.

8. The combination defined in claim 1 wherein the plate and bolt are covered with plastic except at a portion of the bolt engageable with a door-latch fork.

9. The combination defined in claim 8, further comprising a decorative cover fitted over the outer face of the mounting plate.

10. The combination defined in claim 9 wherein the cover is snap-fitted to the plate.

11. The combination defined in claim 1 wherein the bolt and plate are metallic and the bolt is U-shaped.

12. The combination defined in claim 1 wherein the centering formations are cylindrical.

* * * * *